US008903261B2

(12) United States Patent
Maruyama et al.

(10) Patent No.: US 8,903,261 B2
(45) Date of Patent: Dec. 2, 2014

(54) HEATING APPARATUS AND IMAGE FORMING APPARATUS HAVING THE SAME

(75) Inventors: Tsuyoshi Maruyama, Nagoya (JP); Katsumi Inukai, Iwakura (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 386 days.

(21) Appl. No.: 13/414,660

(22) Filed: Mar. 7, 2012

(65) Prior Publication Data

US 2012/0230744 A1 Sep. 13, 2012

(30) Foreign Application Priority Data

Mar. 8, 2011 (JP) ..... 2011-050452

(51) Int. Cl.
*G03G 15/20* (2006.01)

(52) U.S. Cl.
CPC ..... *G03G 15/2039* (2013.01)
USPC ..... 399/69; 399/37; 399/43; 399/88

(58) Field of Classification Search
CPC ..... G03G 15/20; G03G 15/2039; G03G 15/5004; G03G 15/80; G03G 2215/20
USPC ..... 399/69, 88, 37, 43, 67; 219/216
See application file for complete search history.

(56) References Cited

U.S. PATENT DOCUMENTS

| | | | |
|---|---|---|---|
| 5,464,964 | A | 11/1995 | Okuda et al. |
| 5,669,038 | A | 9/1997 | Kishimoto |
| 6,301,454 | B1 | 10/2001 | Nishida et al. |
| 7,015,431 | B2 | 3/2006 | Yoshimura |
| 8,331,819 | B2 | 12/2012 | Fukuzawa et al. |
| 8,340,543 | B2 | 12/2012 | Ogiso et al. |
| 8,705,997 | B2 * | 4/2014 | Suzuki et al. ..... 399/69 |
| 2003/0072581 | A1 | 4/2003 | Nishida |
| 2009/0290893 | A1 | 11/2009 | Ogiso et al. |
| 2009/0297199 | A1 | 12/2009 | Yamashina et al. |
| 2012/0230717 | A1 | 9/2012 | Suzuki et al. |
| 2012/0301171 | A1 | 11/2012 | Maruyama |

FOREIGN PATENT DOCUMENTS

| | | | |
|---|---|---|---|
| JP | H05-289562 | A | 11/1993 |
| JP | H08-297429 | A | 11/1996 |
| JP | H10-091037 | A | 4/1998 |
| JP | H10-213996 | A | 8/1998 |
| JP | 2002-116669 | A | 4/2002 |

(Continued)

OTHER PUBLICATIONS

Machine translation of JP 2007-003663 (publication date of Jan. 11, 2007) translated on May 19, 2014.*

(Continued)

*Primary Examiner* — Sophia S Chen
(74) *Attorney, Agent, or Firm* — Baker Botts L.L.P.

(57) ABSTRACT

A heating apparatus includes a switching circuit configured to switch on/off current-feeding from an AC power source to the heater, a temperature detector configured to detect a temperature of the heater, and a current-feed controller configured to execute a first current-feed mode of changing a current-feed ratio of current-feeding time to unit time by controlling switching of the switching circuit so that the temperature detected by the temperature detector falls within a target range. The current-feed controller executes a second current-feed mode of fixing the current-feed ratio to almost 100% or almost 0% during execution of the first current-feed mode in place of the first current-feed mode.

40 Claims, 10 Drawing Sheets

(56) References Cited

FOREIGN PATENT DOCUMENTS

| | | | |
|---|---|---|---|
| JP | 2002-182521 | A | 6/2002 |
| JP | 2002-278351 | A | 9/2002 |
| JP | 2004-191710 | A | 7/2004 |
| JP | 2005-012977 | A | 1/2005 |
| JP | 2007-003663 | A | 1/2007 |
| JP | 2007-047559 | A | 2/2007 |
| JP | 2008-122757 | A | 5/2008 |
| JP | 2009-282162 | A | 12/2009 |

OTHER PUBLICATIONS

Machine translation of JP 2004-191710 (publication date of Jul. 8, 2004) translated on May 19, 2014.*

Japan Patent Office, Notification of Reasons for Refusal for Japanese Patent Application No. 2011-050460 (related to above-captioned patent application), mailed May 30, 2013.

Japan Patent Office, Notification of Reasons for Refusal for Japanese Patent Application No. 2011-050452 (counterpart Japanese patent application), dispatched Jan. 29, 2013.

United States Patent and Trademark Office, Non Final Office Action for U.S. Appl. No. 13/414,661 (related to above-captioned patent application), mailed Aug. 26, 2013.

Machine Translation of Patent Applicatin Publication No. JP 2009-282162 A.

Japan Patent Office, Notification of Reasons for Refusal for Japanese Patent Application No. 2011-050460 (counterpart Japanese patent application), dispatched Mar. 28, 2013.

European Patent Office, extended European Search Report for European Patent Application No. 12158289.4 (counterpart European patent application), dated May 10, 2013.

* cited by examiner

FIG.4

| ON_DUTY | Control temperature ( C) | Pattern | Harmonic |
|---|---|---|---|
| DUTY0% | 193≦t | 0 | 0.0 |
| DUTY10% | 191≦t<193 | 1000000000 | 0.27 |
| DUTY20% | 189≦t<191 | 10000 | 0.30 |
| DUTY25% | 187≦t<189 | 1000 | 0.52 |
| DUTY30% | 185≦t<187 | 1001001000 | 0.39 |
| DUTY33% | 183≦t<185 | 100 | 0.42 |
| DUTY38% | 181≦t<183 | 10010010 | 0.46 |
| DUTY40% | 179≦t<181 | 10100 | 0.48 |
| DUTY43% | 177≦t<179 | 1010100 | 0.59 |
| DUTY46% | 175≦t<177 | 1010101010100 | 0.83 |
| DUTY50% | 175≦t<177 | 10 | 1.0 |
| DUTY57% | 173≦t<175 | 1101010 | 0.54 |
| DUTY67% | 169≦t<171 | 110 | 0.42 |
| DUTY80% | 165≦t<167 | 11110 | 0.30 |
| DUTY100% | t<165 | 1 | 0.0 |

FIG.7

| ON_DUTY | Control temperature (°C) | | | Pattern |
|---|---|---|---|---|
| | Wave-number control period | DUTY 100% excutable wave-number control period | Low DUTY wave-number control period | |
| DUTY0% | 193≦t | 193≦t | 193≦t | 0 |
| DUTY10% | 191≦t<193 | 191≦t<193 | 191≦t<193 | 1000000000 |
| DUTY20% | 189≦t<191 | 189≦t<191 | 189≦t<191 | 10000 |
| DUTY25% | 187≦t<189 | 187≦t<189 | 187≦t<189 | 1000 |
| DUTY30% | 185≦t<187 | 185≦t<187 | 185≦t<187 | 1001001000 |
| DUTY33% | 183≦t<185 | 183≦t<185 | t<185 | 100 |
| DUTY38% | 181≦t<183 | 181≦t<183 | — | 10010010 |
| DUTY40% | 179≦t<181 | 179≦t<181 | — | 10100 |
| DUTY43% | 177≦t<179 | — | — | 1010100 |
| DUTY46% | 175≦t<177 | — | — | 1010101010100 |
| DUTY50% | 175≦t<177 | — | — | 10 |
| DUTY57% | 173≦t<175 | — | — | 1101010 |
| DUTY67% | 169≦t<171 | — | — | 110 |
| DUTY80% | 165≦t<167 | — | — | 11110 |
| DUTY100% | t<165 | t<179 | — | 1 |

| DUTY 100% limit | Limiting time (ms) |
|---|---|
| 100% continuous ON time upper limit | 400 |
| 100% prohibiting period after 100% ON | 200 |

FIG.9

| ON_DUTY | Control temperature (°C) | | | Pattern |
|---|---|---|---|---|
| | Wave-number control period | DUTY 100% period | Low DUTY wave-number control period | |
| DUTY0% | 193≦t | — | 193≦t | 0 |
| DUTY10% | 191≦t<193 | — | 191≦t<193 | 1000000000 |
| DUTY20% | 189≦t<191 | — | 189≦t<191 | 10000 |
| DUTY25% | 187≦t<189 | — | 187≦t<189 | 1000 |
| DUTY30% | 185≦t<187 | — | 185≦t<187 | 1001001000 |
| DUTY33% | 183≦t<185 | — | t<185 | 100 |
| DUTY38% | 181≦t<183 | — | — | 10010010 |
| DUTY40% | 179≦t<181 | — | — | 10100 |
| DUTY43% | 177≦t<179 | — | — | 1010100 |
| DUTY46% | 175≦t<177 | — | — | 1010101010100 |
| DUTY50% | 175≦t<177 | — | — | 10 |
| DUTY57% | 173≦t<175 | — | — | 1101010 |
| DUTY67% | 169≦t<171 | — | — | 110 |
| DUTY80% | 165≦t<167 | — | — | 11110 |
| DUTY100% | t<165 | — | — | 1 |

| DUTY 100% limit | Limiting time (ms) |
|---|---|
| 100% continuous ON time upper limit | 400 |
| 100% prohibiting period after 100% ON | 200 |

HEATING APPARATUS AND IMAGE FORMING APPARATUS HAVING THE SAME

CROSS REFERENCE TO RELATED APPLICATION

This application claims priority from Japanese Patent Application No. 2011-050452 filed on Mar. 8, 2011. The entire content of this priority application is incorporated herein by reference.

TECHNICAL FIELD

The present invention relates to a heating apparatus and an image forming apparatus having the heating apparatus, in particular, a technique of restraining occurrence of high-frequency wave in current-feed of the heating apparatus.

BACKGROUND

As a conventional technique of restraining occurrence of high-frequency wave, in other word, harmonic current in current-feed of the heating apparatus, for example, a technique is known which turns on the current-feed by 100% when the heater temperature is less than a lower limit value, turns off the current-feed when the heater temperature is higher than an upper limit value, and a sine-wave alternating current (AC) is periodically turned on/off in synchronization with zero cross of a sine-wave AC when the heater temperature falls between the upper limit value and the lower limit value.

According to the known technique, high-frequency wave occurring at turning on/off of the sine-wave AC can be reduced. However, a standard value of a harmonic current in heaters has been recently become strict and therefore, in heating control of the heaters, a technique of further restraining the harmonic current has been demanded. The present invention provides a technique of improving the effect of restraining the harmonic current in heating control of the heaters.

SUMMARY

A heating apparatus disclosed in this specification includes a heater, a switching circuit configured to switch on/off current-feeding from an AC power source to the heater, a temperature detector configured to detect a temperature of the heater, and a current-feed controller configured to execute a first current-feed mode of changing a current-feed ratio of current-feeding time to unit time by controlling switching of the switching circuit so that the temperature detected by the temperature detector falls within a target range. The current-feed controller also executes a second current-feed mode of fixing the current-feed ratio to almost 100% or almost 0% during execution of the first current-feed mode in place of the first current-feed mode.

BRIEF DESCRIPTION OF THE DRAWINGS

FIG. 4 is a chart showing an example among a DUTY ratio, a control temperature and a waveform pattern;

FIG. 7 is a chart showing relationship among the DUTY ratio, each control period and the waveform pattern according to the first illustrative aspect;

FIG. 9 is a chart showing relationship among the DUTY ratio, each control period and the waveform pattern according to the second illustrative aspect.

DETAILED DESCRIPTION OF THE ILLUSTRATIVE ASPECTS

First Illustrative Aspect

A first illustrative aspect will next be described with reference to FIGS. 1 to 7.

1. Configuration of Laser Printer

Figure 1:
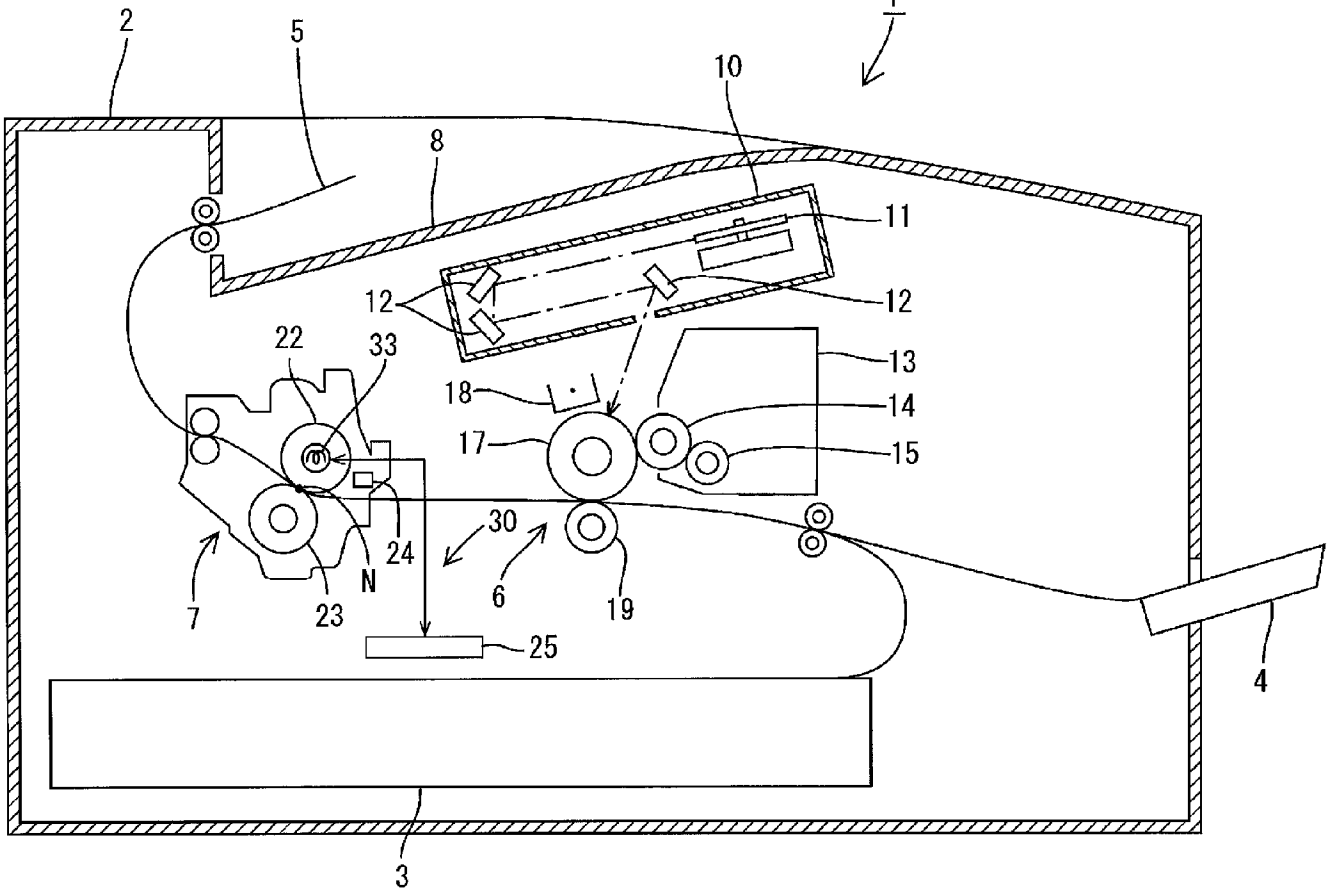
FIG. 1 is a side sectional view showing a schematic configuration of an image forming apparatus according to a first illustrative aspect.

FIG. 1 is a view schematically showing a vertical cross section of a monochrome laser printer 1 (an example of an "image forming apparatus") according to the first illustrative aspect. The image forming apparatus is not limited to the monochrome laser printer, and for example, may be a color laser printer, a color LED printer or a multiple function machine or the like.

In the monochrome laser printer (hereinafter referred to as a "printer") 1, an image forming unit 6 forms a toner image on a sheet 5 fed from a tray 3, which is disposed in a lower portion of a body casing 2, or a tray 4 and then, a fusing unit 7 heats the toner image to perform fusing process and finally, the sheet 5 is ejected to a sheet output tray 8 located in an upper portion of the body casing 2.

The image forming unit 6 includes a scanner unit 10, a developing cartridge 13, a photoconductive drum 17, a charging unit 18 and a transfer roller 19 and the like.

The scanner unit 10 is disposed in the upper portion of the body casing 2 and includes a laser light emitting part (not shown), a polygon mirror 11, a plurality of reflecting mirrors 12 and a plurality of lenses (not shown) and the like. The scanner unit 10 irradiates the surface of the photoconductive drum 17 with laser light emitted from the laser light emitting part through the polygon mirror 11, the reflecting mirrors 12 and the lenses by high-speed scanning as represented by a dashed line.

The developing cartridge 13 is detachably attached to the body casing 2 and stores toner therein. A developing roller 14 and a feeding roller 15 are provided at a toner feeding port of the developing cartridge 13 as opposed to each other, and the developing roller 14 is also disposed as opposed to the photoconductive drum 17. The toner stored in the developing cartridge 13 is fed to the developing roller 14 with rotation of the feeding roller 15, and carried by the developing roller 14.

The charging unit 18 is disposed above the photoconductive drum 17 with an interval therebetween. The transfer roller 19 is disposed below the photoconductive drum 17 as opposed to the photoconductive drum 17.

While being rotated, the surface of the photoconductive drum 17 is charged uniformly, for example, positively charged by the charging unit 18. Next, an electrostatic latent image is formed on the photoconductive drum 17 by the laser light from the scanner unit 10, and then, the photoconductive drum 17 contacts with the developing roller 14 and rotates. At this time, the toner carried on the developing roller 14 is fed to the electrostatic latent image on the photoconductive drum 17 and carried thereon to form a toner image. After that, while the sheet 5 passes between the photoconductive drum 17 and the transfer roller 19, the toner image is transferred to the sheet 5 by transfer bias applied to the transfer roller 19.

The fusing unit (an example of a heating apparatus) 7 is disposed downstream from the image forming unit 6 in a sheet convey direction and includes a fusing roller (an example of a heater) 22, a pressure roller (an example of a rotator) 23 pressing the fusing roller 22 and a halogen heater (an example of a heater) 33 heating the fusing roller 22 and the like. The halogen heater 33 is provided within the fusing roller 22 and is connected to a circuit board 25 for current-feed control according to a signal from the circuit board 25. Here, the fusing roller 22 and the halogen heater 33 configure the heater. The sheet 5 is nipped at a position where the fusing roller 22 and the pressure roller 23 are opposed to each other and at the nip position (fusing position) N, the toner image is thermally fused to the sheet 5.

The configuration of the fusing unit 7 is not limited to this. For example, the fusing unit 7 may be a fusing unit of so-called film fusing type using a fusing film in place of the fusing roller 22. In this case, for example, the fusing film and a halogen lamp configure the heater.

A temperature sensor (an example of a temperature detector) 24 detecting temperature of the halogen heater 33 is provided in the vicinity of the halogen heater 33.

2. Electric Configuration of Heating Apparatus

Figure 2:
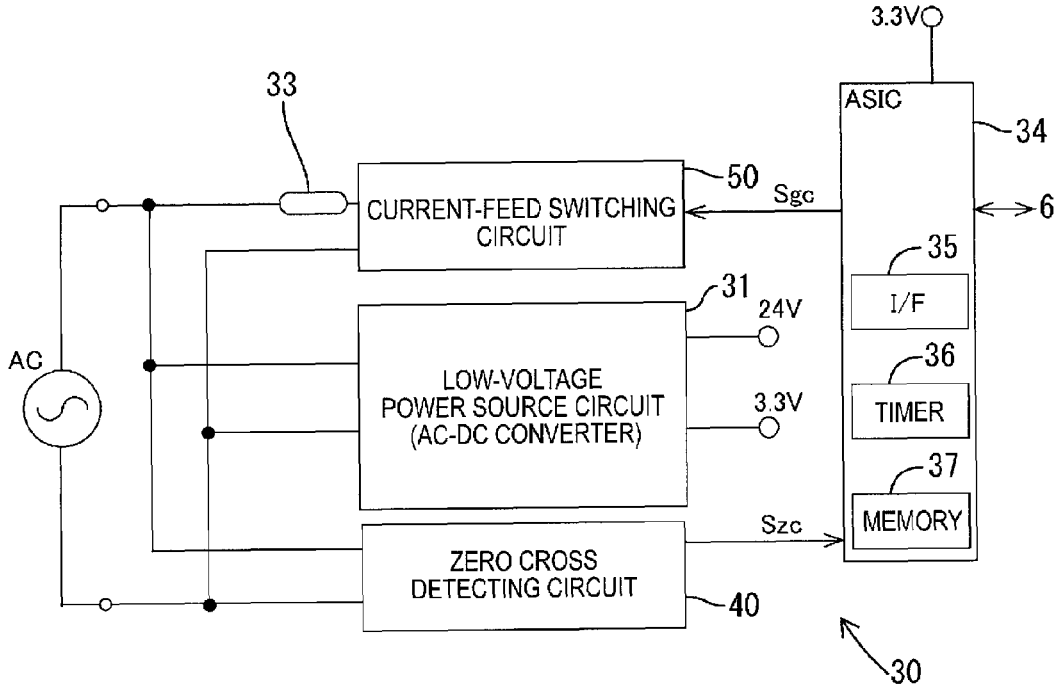
FIG. 2 is a block diagram showing a schematic configuration of a heating apparatus according to the first illustrative aspect.
Figure 3:
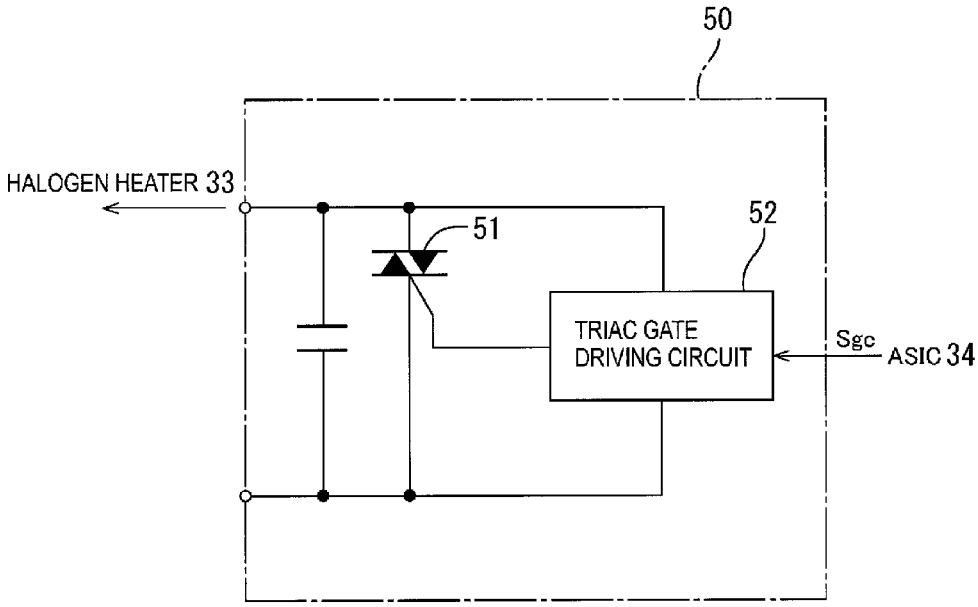
FIG. 3 is a block diagram showing a schematic configuration of a current-feed switching circuit of the heating apparatus.

Next, a heating apparatus 30 provided in the printer 1 will be described with reference to FIGS. 2 and 3. FIG. 2 is a block diagram showing a schematic configuration of the heating apparatus 30. FIG. 3 is a block diagram showing schematic configuration of a current-feed switching circuit (an example of a switching circuit) 50 of the heating apparatus 30.

The heating apparatus 30 includes a low-voltage power source circuit (AC-DC converter) 31, the halogen heater 33, an ASIC (Application Specific Integrated Circuit) 34, a zero cross detecting circuit 40 and the current-feed switching circuit 50 and the like. Here, each circuit except for the halogen heater 33 is provided on the circuit board 25. The low-voltage power source circuit 31 is not necessarily included in the heating apparatus 30.

The low-voltage power source circuit 31 converts, for example, an AC voltage of 100 V into a DC voltage of 24 V and 3.3 V and feeds the DC voltage to each part. The halogen heater 33 generates heat according to current-feed by an AC power source AC. Here, the word "current-feed" means "current-supplying" or "power-supplying".

The zero cross detecting circuit 40 generates a zero cross signal Szc in synchronization with a zero cross timing of the sine-wave alternating current power source (hereinafter referred to as AC power source) AC. The ASIC 34 controls the current-feed of the current-feed switching circuit 50 in synchronization with the zero cross signal Szc.

Using the zero cross signal Szc as a reference, the current-feed switching circuit 50 adjusts a current-feed time of the AC power source AC to the halogen heater 33. Specifically, as shown in FIG. 3, the current-feed switching circuit 50 includes, for example, a triac 51 and a triac gate driving circuit 52. The triac gate driving circuit 52 receives a gate control signal Sgc from the ASIC 34 and turns on/off the triac 51 according to the gate control signal Sgc, thereby switching the turning on/off of current-feed from the AC power source AC to the halogen heater 33.

The ASIC (an example of a current-feed controller) 34 includes an interface circuit 35, a timer 36 and a memory 37 and the like, and controls the current-feed switching circuit 50 to perform current-feed control of the fusing unit 7. The ASIC 34 is connected to the image forming unit 6 and also performs controls related to image formation. The interface circuit 35 mediates exchange of various data with the outside of the ASIC. The timer 36 is used to measure various current-feed times in the current-feed control of the fusing unit 7. The memory 37 includes a ROM and a RAM. The configuration of the current-feed controller is not limited to the ASIC 34 and may be, for example, a CPU or discrete circuits.

Basically, the ASIC 34 executes a first current-feed mode of controlling switching of the triac 51 to change a wave-number duty ratio so that temperature detected by the temperature sensor 24 falls within a target range. The ASIC 34 executes a second current-feed mode of fixing the wave-number duty ratio to almost 100% or almost 0% during execution of the first current-feed mode or in place of execution of the first current-feed mode. Here, the wave-number duty ratio means a duty ratio in the case of wave-number control of the AC power source AC, and is an example of a current-feed ratio. The current-feed ratio means a ratio of current-feed (from the AC power source AC to the halogen heater 33) time to a unit time.

3. Current-Feed Control of Heating Apparatus (Fusing Unit)

Figure 5:
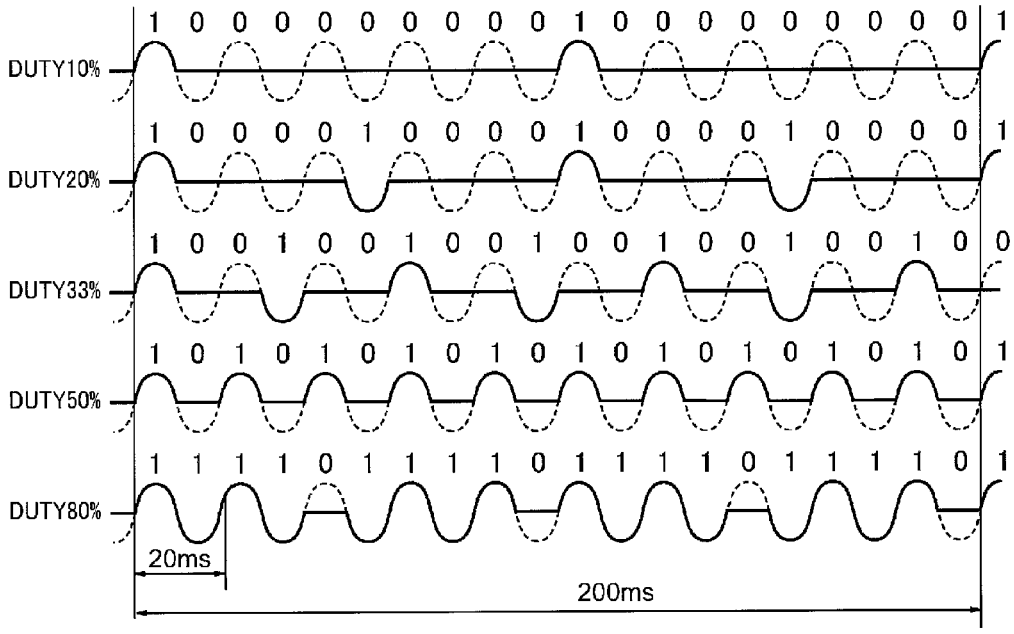
FIG. 5 is a timing chart showing an example of the DUTY ratio and the waveform pattern.

Next, the current-feed control of the fusing unit 7 according to the first illustrative aspect will be described with reference to FIGS. 4 to 7. First, wave-number control according to the first illustrative aspect will be described with reference to FIGS. 4 and 5. FIG. 4 is a chart showing an example among the wave-number duty ratio DUTY, control temperature and a waveform pattern. FIG. 5 is a timing chart showing relationship between the wave-number duty ratio DUTY and the waveform pattern. In FIG. 4, the high-frequency wave (harmonic) amount is standardized by setting an average value of the high-frequency wave amount at DUTY of 50% at which the high-frequency wave amount becomes maximum to "1.0".

According to the first illustrative aspect, as shown in FIG. 4 and FIG. 5, wave-number control is performed in units of half-wave. In the pattern shown in FIG. 4, a figure "1" represents that the half-wave is valid and a figure "0" represents that the half-wave is invalid (refer to FIG. 5). Specifically, when the frequency of the AC power source AC is set to 50 Hz, the cycle of the AC power source AC is 20 milliseconds (ms), and here, when the unit time is set to 200 ms, the wave number for the unit time becomes "10". For example, as shown in FIG. 4, the half-wave pattern in the case of the wave-number duty ratio DUTY of 20% becomes "10000". The pattern is repeated four times for the unit time (200 ms) and the wave number for the unit time is 4×half-wave=2. That is, in this case, the wave-number duty ratio DUTY is $(2/10)\times 100=20\%$. The unit time of "200 ms" herein is measuring unit time in obtaining the high-frequency wave amount.

Generally, a harmonic current value (secondary average value) at each wave-number duty ratio DUTY becomes larger according to the number of times of turning on/off switching of the AC power source AC in units of half-wave. That is, since switching is not performed at the wave-number duty ratio DUTY of 0% and 100%, the harmonic current value is a minimum value. At the wave-number duty ratio DUTY of 20%, the harmonic current value increases and becomes almost the same value as that at the DUTY of 80%. The harmonic current further increases at the DUTY of 30% (or 70%), and becomes maximum at the DUTY of 50% (refer to FIG. 4).

Since the number of times of turning on/off switching varies according to the mode of the waveform pattern, the harmonic current varies even at the same wave-number duty ratio DUTY. Generally in wave-number control, each waveform pattern is determined so as to fall within the range of the harmonic current standard value relative to each set wave-number duty ratio DUTY. Alternatively, wave-number control is performed so as to satisfy the standard of the harmonic current by avoiding the wave-number duty ratio DUTY that falls outside of the range of the harmonic current standard value in the set waveform pattern.

Figure 6:
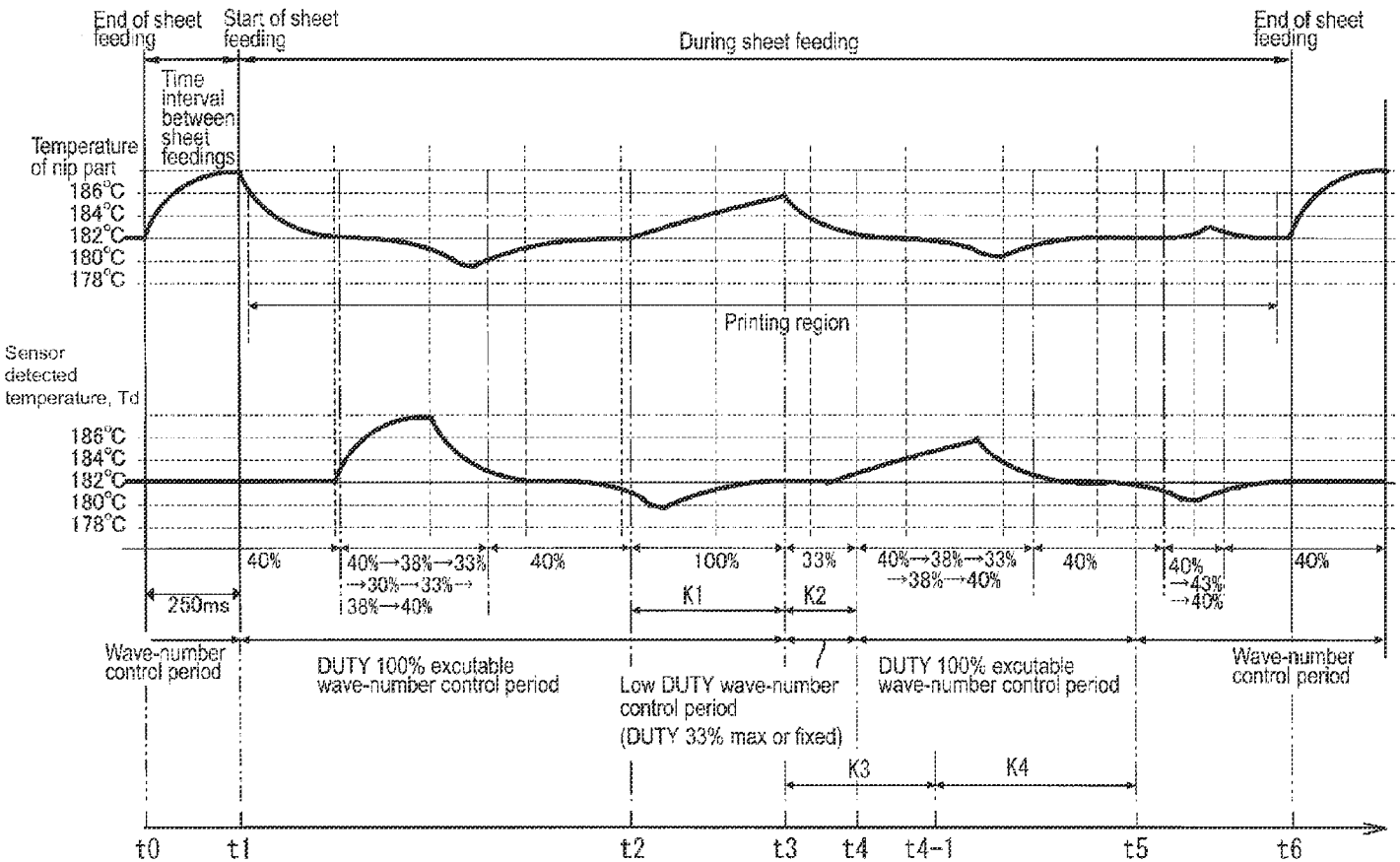
FIG. 6 is a timing chart showing a current-feed control according to the first illustrative aspect.

Next, the current-feed control of the fusing unit 7 according to the first illustrative aspect will be described with reference to FIGS. 6 and 7. FIG. 6 is a timing chart of current-feed control in a fusing process of one sheet 5 according to the first illustrative aspect. The reason why the temperature is detected by the temperature sensor 24 with delay of about 500 ms in FIG. 6 is that the temperature sensor 24 does not directly detect the temperature of the halogen heater 33. Actual current-feed control allows for this delay in detection temperature. FIG. 7 is a chart showing an example of relationship among the wave-number duty ratio DUTY, a control temperature and a waveform pattern according to the first illustrative aspect.

For example, when the user issues a printing command to the printer 1, the ASIC 34 performs the current-feed control of the fusing unit 7 according to a predetermined program stored in the memory 37. The ASIC 34 performs the current-feed control on the basis of the temperature detected by the temperature sensor 24.

As shown in FIG. 7, a period of the current-feed control processing is divided into a "wave-number control period", a "DUTY 100% executable wave-number control period" and a "low-DUTY wave-number control period", and for each period, the DUTY ratio and the pattern, which correspond to the detection temperature, are selected. In the "wave-number control period", normal DUTY ratio control (corresponding to the first current-feed mode) is executed.

In the "DUTY 100% executable wave-number control period", control of fixing the DUTY ratio to almost 100% (corresponding to a second current-feed mode) can be executed. Here, as shown in FIG. 7, only when the detection temperature is lower than 179° C., the DUTY ratio 100% is executed. The upper limit value of a fixed period K1 fixing the DUTY ratio to 100% is set to 400 ms, and 200 ms after completion of the current-feed at the DUTY ratio 100% is defined as a DUTY ratio 100% current-feed prohibiting period. The "DUTY ratio of almost 100%" includes DUTY ratio of 99% or 98%, and is not limited to the DUTY ratio 100%.

The "low-DUTY wave-number control period" is a period K2 (corresponding to a third current-feed mode) in which the switching circuit 50 is controlled at the DUTY ratio that is smaller than that in ordinary DUTY ratio control, after execution of the DUTY ratio 100% and before execution of ordinary DUTY ratio control.

It is assumed that at time t0 in FIG. 6, fusing of the last sheet 5 is finished to complete feeding of the last sheet 5 to the fusing unit 7, and at time t1, feeding of the next sheet 5 to the fusing unit 7 is started. A time interval between sheet feedings from time t0 to time t1, that is, an interval period in which the sheet 5 is conveyed to the fusing unit 7, is defined as the "wave-number control period", and is controlled at the DUTY ratio 40%, for example.

Next, the "DUTY 100% executable wave-number control period" starts from time t1, and to lower a detection temperature Td, for example, the ASIC 34 varies the DUTY ratio to 40%, 38%, 33%, 30%, 33%, 38% and 40% in this order, that is executes the first current-feed mode. Then, when the detection temperature Td becomes lower than 179° C. at time t2, the ASIC 34 executes the current-feed control at the DUTY ratio 100%, that is, the second current-feed mode, for the fixed period K1.

Here, as shown in FIG. 6, at a timing when the detection temperature Td is higher than a heating target lower limit value and is lower than a heating target temperature (180° C.), the ASIC 34 executes the second current-feed mode. This enables reduction of the possibility that the detection temperature Td becomes equal to or higher than a target temperature upper limit value. As shown in FIG. 6, the ASIC 34 also executes the second current-feed mode at a timing when the detection temperature Td decreases (refer to FIG. 6). This can further reduce the possibility that the detection temperature Td becomes equal to or higher than the target temperature upper limit value.

Here, the fixed period K1 is set to be equal to or longer than a predetermined period. For example, the predetermined period is set to a unit time of measuring harmonic current specified in the harmonic current standard, such as 200 ms, and the fixed period K1 is set to almost 350 ms. By setting the fixed period K1 in this manner, the harmonic current can suitably be restrained so as to satisfy the harmonic current standard.

The fixed period K1 is preferably long as much as possible in terms of the harmonic current, but is preferably short in terms of ripple of fusing temperature. Here, the upper limit of the fixed period K1 is defined as 400 ms.

It is preferred that the fixed period K1 is longer as power consumption of the halogen heater 33 is larger. Generally, as power consumption of the halogen heater 33 is larger, the intensity of the harmonic with change of the current-feed ratio is larger. For this reason, by increasing the fixed period K1 as power consumption of the halogen heater 33 is larger, the good balance between restraint of the harmonic current by the second current-feed mode and stabilization of the detection temperature by the first current-feed mode can be achieved according to power consumption of the halogen heater 33.

Further, it is preferred that the fixed period K1 is equal to or larger than a time restraining illumination flicker due to heating control of the halogen heater 33. By setting the fixed period K1 in this manner, illumination flicker due to heating control can be restrained. For example, to restrain illumination flicker, the fixed period K1 is preferably equal to or larger than 500 ms.

Next, when the fixed period K1 at the DUTY ratio 100% (the second current-feed mode) is finished at time t3 in FIG. 6, a period from time t3 to time t4 is defined as the "low-DUTY wave-number control period", and the ASIC 34 executes the current-feed control of changing the DUTY ratio in the range up to 33% or fixing the DUTY ratio to 33% for a predetermined time (the third current-feed mode). By executing the third current-feed mode after the second current-feed mode in this manner, the possibility that the detection temperature Td becomes equal to or higher than the target temperature upper limit value can be reduced.

In this case, it is preferred that the third current-feed mode is executed in a period in which the detection temperature Td is lower than the heating target temperature as the above-mentioned predetermined period, that is, a period in which the detection temperature Td is lower than 180° C. Thereby, when the third current-feed mode is switched to the first current-feed mode, it is easier to stabilize the detection temperature Td.

Next, a period from time t4 to time t5 in FIG. 6 is set as the "DUTY 100% executable wave-number control period" again, and the ASIC 34 changes the DUTY ratio, for example, to 40%, 38%, 33%, 38% and 40% in this order, that is, executes the first current-feed mode. Next, a period from time t5 in FIG. 6 to time t6 at which feeding of the sheet 5 is finished is set as the "wave-number control period" again, and the ASIC 34 changes the DUTY ratio, for example, to 40%, 43% and 40% in this order, that is, executes the first current-feed mode. Thereafter, processing from time t0 to time t6 is repeated until the fusing process of all sheets 5 to be printed is finished.

In the case where the DUTY ratio is fixed to almost 100% in the second current-feed mode, it is preferred that the ASIC 34 prohibits execution of the second current-feed mode at the time interval between sheet feedings (time t0 to t1 in FIG. 6). Since there is no sheet 5 in the time interval between sheet feedings, the temperature of the fusing unit 7 tends to increase. Thus, by prohibiting execution of the second current-feed mode in this period, the detection temperature Td can be restrained from being equal to or higher than the target temperature upper limit value.

4. Effect of First Illustrative Aspect

As described above, according to the first illustrative aspect, in heating control of the fusing unit 7, during execution of the first current-feed mode of changing the DUTY ratio in wave-number control, the ASIC 34 executes the second current-feed mode of fixing the DUTY ratio to almost 100% for the fixed period ICI, in place of the first current-feed mode. By temporarily providing the fixed period K1 in which the DUTY ratio is fixed to almost 100% during execution of the first current-feed mode, that is, temporarily providing the period in which an AC current is fully passed and switching of the AC current is not performed, the effect of restraining the harmonic current can be improved.

Second Illustrative Aspect

Figure 8:
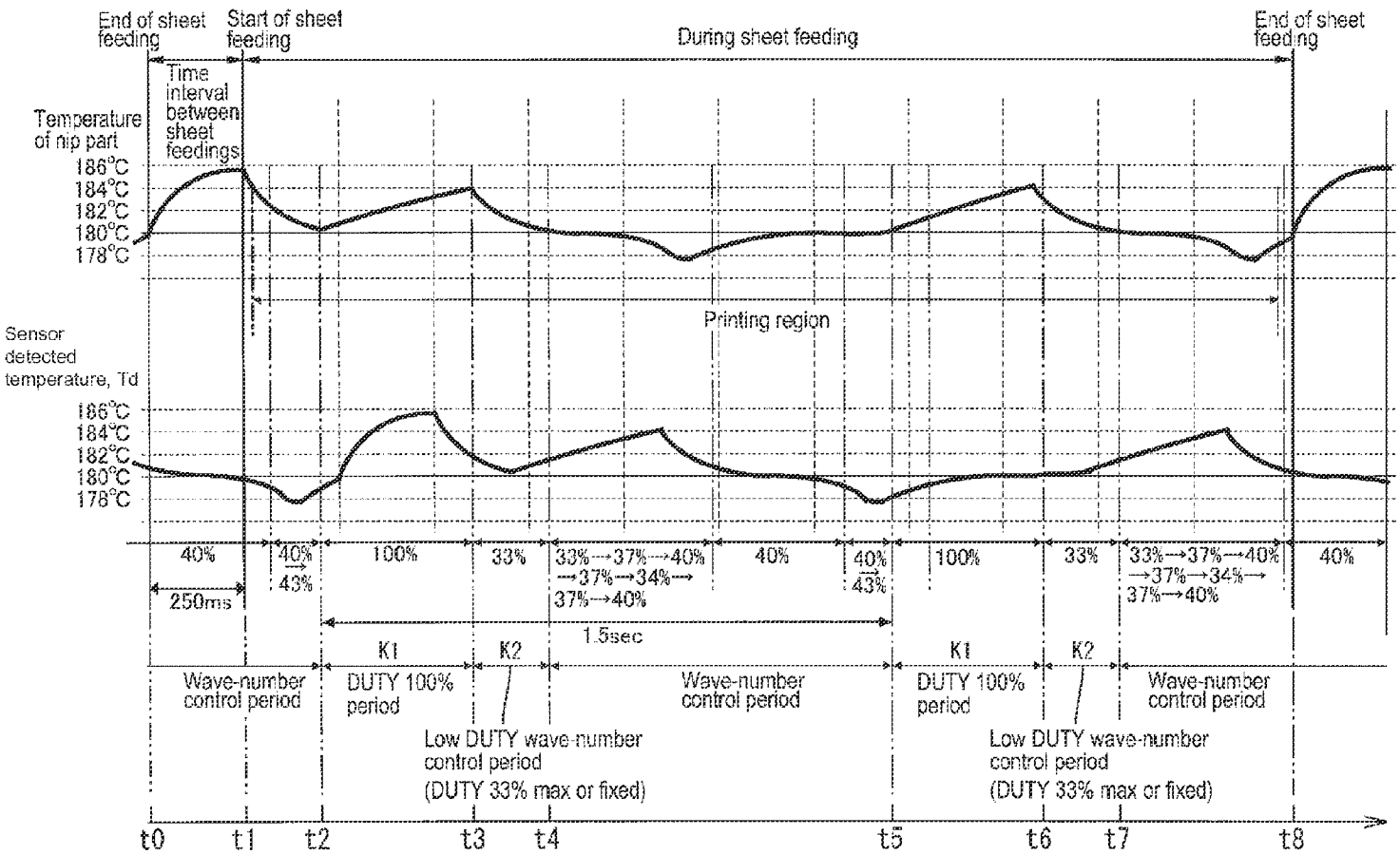
FIG. 8 is a timing chart showing current-feed control according to a second illustrative aspect.

Next, a second illustrative aspect will be described with reference to FIGS. 8 and 9. Since the second illustrative aspect is different from the first illustrative aspect only in the current-feed control of the fusing unit 7, only the difference between the second illustrative aspect and the first illustrative aspect will be described below. FIG. 8 is a timing chart of the current-feed control in fusing process of one sheet 5 according to the second illustrative aspect. FIG. 9 is a chart showing an example of relationship among the wave-number duty ratio DUTY, control temperature and waveform pattern according to the second illustrative aspect.

According to the second illustrative aspect, as shown in FIGS. 8 and 9, in place of the "DUTY 100% executable wave-number control period", a "DUTY 100% period (fixed period K1)" of forcibly fixing the DUTY ratio to 100% during execution of the first current-feed mode is provided twice at predetermined intervals.

The "DUTY 100% period" is different from the "DUTY 100% executable wave-number control period" according to the first illustrative aspect, and is a period in which the DUTY ratio is forcibly shifted to 100% under predetermined conditions. The predetermined conditions do not include any temperature condition as shown in FIG. 9. However, a temperature condition may be provided.

As the predetermined conditions, for example, the duty ratio is forcibly shifted to 100% periodically at every predetermined period for predetermined period. Alternatively, when a much harmonic DUTY ratio such as the DUTY ratio 50% continues for a predetermined period, the duty ratio is forcibly shifted to 100%. Alternatively, when DUTY 100% for a predetermined period is not executed in a predetermined period, the duty ratio is shifted.

In an example shown in FIG. 8, a period from time t0 to time t2, a period from time t4 to time t5 and a period from time t7 to time t8 each are set as the "wave-number control period", and the first current-feed mode of changing the DUTY ratio according to the detection temperature Td is executed in these periods.

A period from time t2 to time t3 and a period from time t5 to time t6 in FIG. 8 each are set as the "DUTY 100% period", and the second current-feed mode of fixing the DUTY ratio to almost 100% is executed in these periods. A period from time t3 to time t4 and a period from time t6 to time t7 in FIG. 8 are set as the "low-DUTY wave-number control period", and the third current-feed mode of performing wave-number control at the DUTY ratio that is smaller than that in the first current-feed mode, such as the DUTY ratio 33% is executed in these periods.

In this example, two "DUTY 100% periods" for a predetermined time K1 are provided at predetermined interval during the execution period of the first current-feed mode (time t0 to time t8). For example, the predetermined intervals are 1.5 seconds (sec) and the predetermined time K1 is 370 ms.

The first "DUTY 100% period" starts at time t2 at which a predetermined time has elapsed since time t1 as a sheet feeding start. In other words, according to the second illustrative aspect, the ASIC 34 executes the second current-feed mode at the DUTY ratio 100% according to a timing at which the sheet 5 is nipped between the fusing roller 22 and the pressure roller 23 (time t1 in FIG. 8). For this reason, in the case where a plurality of sheets 5 is printed in a printing job, variation in the sheets 5 in the fusing state can be restrained.

5. Effect of Second Illustrative Aspect

The current-feed controller executes the second current-feed mode twice (plural times) at predetermined interval during the execution period of the first current-feed mode (time t0 to time t8). For this reason, when executing the second current-feed mode, in place of the first current-feed mode, for example, at the DUTY 100% for a predetermined period during execution of the first current-feed mode, so that a driving current of the fusing unit 7 falls within the standard range of the high-frequency current value (harmonic current value), the predetermined period can be distributed into a plurality of fixed periods K1. As a result, it can be prevented that the temperature of the fusing unit 7 excessively increases due to too long predetermined period in which the second current-feed mode is executed. That is, the detection temperature can stably fall within the target range while improving the effect of restraining the harmonic current.

Third Illustrative Aspect

Figure 10:
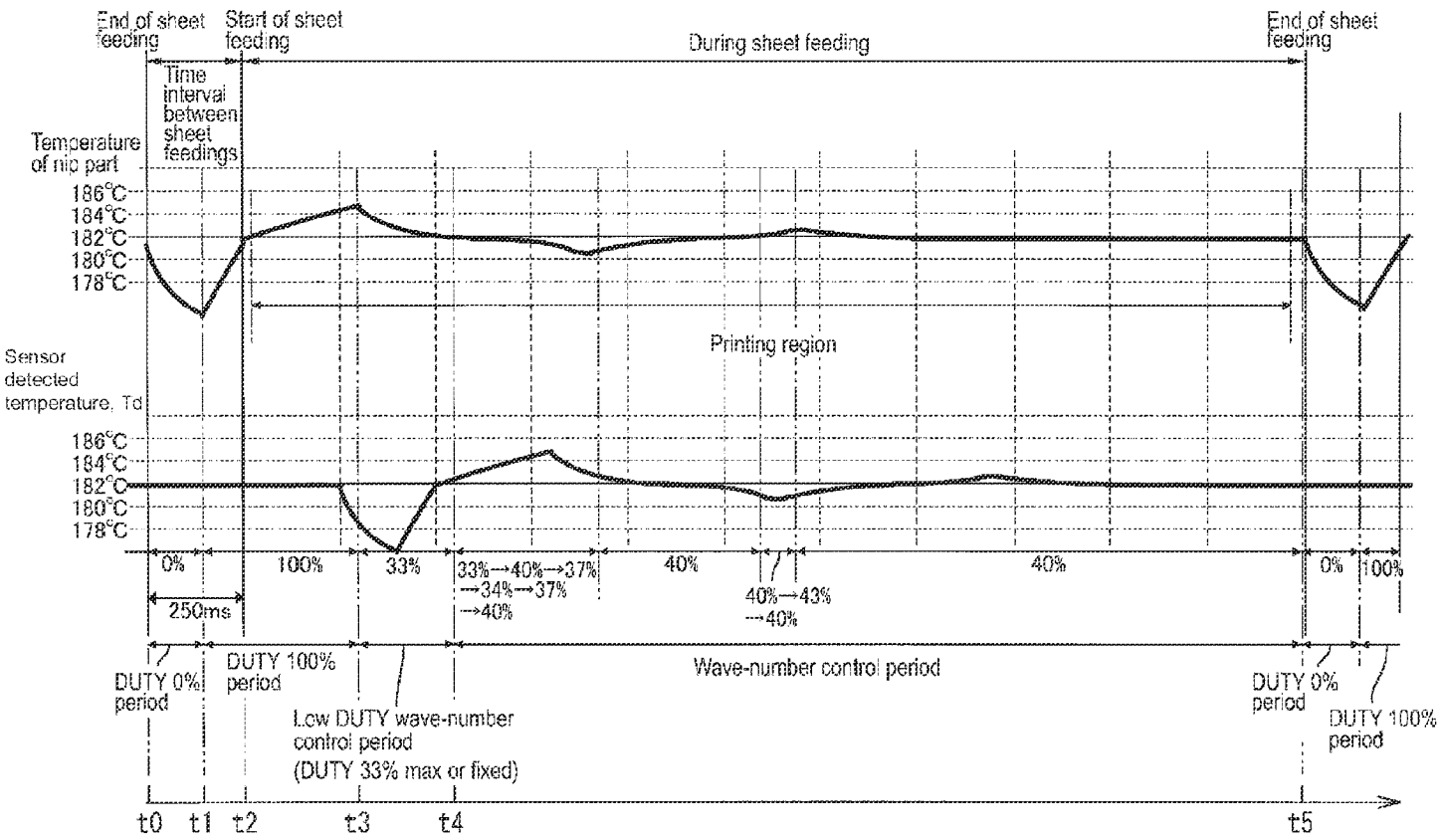
FIG. 10 is a timing chart showing a current-feed control according to a third illustrative aspect.

Next, a third illustrative aspect will be descried with reference to FIG. 10. Like the second illustrative aspect, the third illustrative aspect is different from the first illustrative aspect only in the current-feed control of the fusing unit 7 and thus, only the difference between the third illustrative aspect and the first illustrative aspect will be described below. FIG. 10 is a timing chart of the current-feed control in fusing process of one sheet 5 according to the third illustrative aspect. Since relationship among the wave-number duty ratio DUTY, the control temperature and the waveform pattern in the third illustrative aspect is similar to that in the second illustrative aspect shown in FIG. 9, illustration thereof is omitted. The DUTY ratio 100% prohibiting period after the DUTY ratio 100% in the third illustrative aspect is preferably longer than that in the second illustrative aspect and is set to 300 ms.

According to the third illustrative aspect, during execution of the first current-feed mode, the second current-feed mode of fixing the duty ratio DUTY to almost 100% and the second current-feed mode of fixing the duty ratio DUTY to almost 0% are used in combination. That is, the "DUTY 100% period" of fixing the duty ratio DUTY to almost 100% and a "DUTY 0% period" of fixing the duty ratio DUTY to almost 0% are used in combination. Here, the "almost 0% DUTY ratio" includes the DUTY ratio 1% or 2% and is not limited to the DUTY ratio 0%.

In an example shown in FIG. 10, a period from time t0 as a start time of the time interval between sheet feedings to time t1 as a time in the time interval is set as the "DUTY 0% period". Following the "DUTY 0% period", a period from time t1 to time t3 at which the fixed period K1 has elapsed since time t1 is set as the "DUTY 100% period".

A period from time t3 to time t4 in FIG. 8 is set as the "low-DUTY wave-number control period" and the third current-feed mode of performing wave-number control at the DUTY ratio that is smaller than that in the first current-feed mode, such as the DUTY ratio 33% is executed in this period. A period from time t4 to time t5 at which sheet feeding is finished is set as the "wave-number control period", and the first current-feed mode of changing the DUTY ratio to, for example, in the range of 33% to 43% according to the detection temperature Td is executed in this period.

Time t1 at which the "DUTY 0% period" is changed to the "DUTY 100% period" in the time interval between sheet feedings is set to be a time after a predetermined time from the start time t0 in the time interval between sheet feedings, for example, a time at which 150 ms has elapsed since time t0 by estimating temperature of the nip part based on previous data on temperature characteristics of the nip part. Time t1 is not limited to this, and may be determined based on the detection temperature Td detected by the sensor.

The "DUTY 0% period" only needs to be provided in the time interval between sheet feedings (time t0 to time t2 in FIG. 10), and does not necessarily start from the start time t0 of the time interval.

6. Effect of Third Illustrative Aspect

According to the third illustrative aspect, in the time interval between sheet feedings (time t0 to time t1 in FIG. 10), the second current-feed mode in which the DUTY ratio is fixed to almost 0% is executed. Generally, heat is not taken away by the sheet 5 in the time interval between sheet feedings and the temperature of the fusing unit 7 is hard to decrease. Thus, the DUTY ratio is set to almost 0%. That is, even when the current-feed to the halogen heater 33 is turned off, the detection temperature Td is hard to be lower than the target temperature lower limit value. Accordingly, by setting the DUTY ratio with minimum harmonic occurrence to almost 0% from start of the time interval between sheet feedings to the time in the time interval, occurrence of harmonic can be restrained.

Following the "DUTY 0% period", the "DUTY 100% period" is provided. For this reason, the temperature of the fusing unit 7, which has lowered in the time interval between sheet feedings, can suitably be increased, and the period with minimum harmonic occurrence in the sheet fusing process period (time t0 to time t5 in FIG. 10) can be extended to the period from time t0 to time t3 in FIG. 10, thereby suitably reducing a time average value of occurrence of the harmonic current. That is, the effect of restraining the harmonic current can be further improved while restraining occurrence of ripple of the fusing temperature.

Other Illustrative Aspects

The present invention is not limited to the illustrative aspect described in the above description and figures, and for example, following illustrative aspects falls within the technical scope of the present invention.

(1) Although heating at the DUTY 100% is performed for the fixed period K1 and then, the "low-DUTY wave-number control period" is provided according to each of the above-mentioned illustrative aspects, the present invention is not limited to this. For example, when increase in temperature need not be restrained after the fixed period K1, the "low-DUTY wave-number control period" may not be provided.

(2) According to each of the above-mentioned illustrative aspects, in the current-feed control of the fusing unit 7, the wave-number duty ratio is used as the current-feed ratio to perform wave-number control of the AC power source AC. However, the present invention is not limited to this. The present invention can be applied to the case where, in the current-feed control of the fusing unit 7, a phase duty ratio is used as the current-feed ratio to perform phase control of the AC power source AC.

(3) In each of the above-mentioned illustrative aspects, a temperature gradient detector detecting temperature gradient of the detection temperature Td by using the detection temperature Td may further be provided, and the current-feed controller may decrease the fixed period K1 in which the current-feed ratio is fixed in the second current-feed mode as the detected temperature gradient is larger. In this case, it can be restrained that the detection temperature exceeds the target temperature upper limit value or falls below the target temperature lower limit value. That is, since change in the temperature of the fusing unit 7 with respect to the same heat quantity is larger as the temperature gradient (increase or decrease in temperature per unit time) is larger, change in the temperature of the fusing unit 7 can be restrained by decreasing the current-feed time K1 at the DUTY 100% or DUTY 0%.

(4) Although the second current-feed mode of fixing the DUTY ratio to almost 100% during execution of the first current-feed mode according to the above-mentioned illustrative aspects 1 and 2, the present invention is not limited to this. Alternatively, the second current-feed mode of fixing the DUTY ratio to almost 0% may be executed during execution of the first current-feed mode. Even in this case, when the DUTY ratio is almost 0%, power from the AC power source AC is hardly fed and therefore, occurrence of harmonic can be restrained during execution of the second current-feed mode (fixed period K1).

In the case where the DUTY ratio is fixed to almost 0% in the second current-feed mode, contrary to the case where the DUTY ratio is fixed to almost 100%, the ASIC 34 preferably executes a fourth current-feed mode of controlling the current-feed switching circuit 50 at the DUTY ratio that is larger than the DUTY ratio in the first current-feed mode, before execution of the first current-feed mode after execution of the second current-feed mode. This enables reduction of the possibility that the detection temperature Td becomes equal to or lower than the lower limit value of target temperature. For example, in the case, where a period from time t2 to t3 in FIG. 6 is defined as the "DUTY 0% period", a period from time t3 to t4-1 in FIG. 6 (period K3) is set as a "high DUTY wave-number control period" in which the fourth current-feed mode is executed, and a subsequent period from time t4-1 to t5 in FIG. 6 (period K4) is set as a "limiting wave-number control period" of limiting the DUTY ratio (wave number) to a predetermined value.

In the case where the DUTY ratio is fixed to almost 0% in the second current-feed mode, it is preferred that the ASIC 34 executes the second current-feed mode at a timing when the detection temperature Td is higher than the heating target temperature and is lower than the heating target upper limit value. This enables reduction of the possibility that the detection temperature Td becomes equal to or lower than the lower limit value of target temperature.

In this case, it is preferred that the ASIC 34 executes the second current-feed mode at a timing when the detection temperature Td is increasing. This suitably enables restraining of increase in temperature of the fusing unit 7 and further reduction of the possibility that the detection temperature Td becomes equal to or lower than the lower limit value of target temperature.

(5) A high-frequency wave calculator that calculates a high-frequency current value contained in a feeding current to the halogen heater 33 (heater) in a first period may additionally be provided, and the ASIC 34 may determine the period of the second current-feed mode (fixed period K1) required for a second period after the first period on the basis of the calculated high-frequency current value. In this case, in a sum of the first period and the second period, the high-frequency current value contained in the feeding current can be equal to or smaller than a predetermined value.

What is claimed is:

1. A heating apparatus comprising:

a heater;

a switching circuit configured to switch on/off current-feeding from an AC power source to the heater;

a temperature detector configured to detect a temperature of the heater; and a current-feed controller configured to execute a first current-feed mode of changing a current-feed ratio of current-feeding time to unit time by controlling switching of the switching circuit so that the temperature detected by the temperature detector falls within a target range, wherein the current-feed controller executes a second current-feed mode of fixing the current-feed ratio to almost 100% or almost 0% during execution of the first current-feed mode in place of the first current-feed mode, and wherein, in the second current-feed mode, the current-feed controller extends a fixed period in which the current-feed ratio is fixed as power consumption of the heater is larger, wherein, in the second current-feed mode, the current-feed ratio is fixed to almost 100%, and wherein, before execution of the first current-feed mode after execution of the second current-feed mode, the current-feed controller executes a third mode of controlling the switching circuit at a current-feed ratio that is smaller than the current-feed ratio in the first current-feed mode.

2. The heating apparatus according to claim 1, wherein, in the second current-feed mode, the fixed period in which the current-feed ratio is fixed is equal to or larger than a predetermined time.

3. The heating apparatus according to claim 1, wherein the current-feed controller executes the second current-feed mode plural times at predetermined intervals during an execution period of the first current-feed mode.

4. The heating apparatus according to claim 1, wherein the fixed period is a period that is equal to or larger than a time in which illumination flicker due to heating control of the heater is restrained.

5. The heating apparatus according to claim 1, wherein the current-feed controller executes the third mode for a period in which the detection temperature is lower than a heating target temperature.

6. The heating apparatus according to claim 1, wherein the current-feed controller executes the second current-feed mode at a timing when the detection temperature is higher than a heating target lower limit value and is lower than a heating target temperature.

7. The heating apparatus according to claim 6, wherein the current-feed controller executes the second current-feed mode at a timing when the detection temperature decreases.

8. The heating apparatus according to claim 1, further comprising:

a temperature gradient detector configured to detect a temperature gradient of the detection temperature on the basis of the detection temperature, wherein the current-feed controller decreases the fixed period in which the current-feed ratio is fixed in the second current-feed mode as the detected temperature gradient is larger.

9. The heating apparatus according to claim 1, wherein, in the first current-feed mode, the current-feed controller executes a wave-number control to use a ratio of wave-number of the AC power source to the unit time as the current-feed ratio.

10. An image forming apparatus comprising:

an image forming unit configured to form a toner image on a recording medium; and the heating apparatus according to claim 1 as a fusing unit configured to fuse the toner image formed on the recording medium to the recording medium.

11. The image forming apparatus according to claim 10, wherein the current-feed controller prohibits execution of the second current-feed mode in an interval period in which the recording medium is conveyed to the fusing unit.

12. The image forming apparatus according to claim 10, wherein the fusing unit includes a rotator that is disposed as opposed to the heater and rotates to convey the recording medium, and the current-feed controller executes the second current-feed mode of fixing the current-feed ratio to almost 100% according to a timing when the recording medium is nipped between the heater and the rotator.

13. The heating apparatus according to claim 1, wherein the current-feed controller executes the second current-feed mode at a timing when the detection temperature is higher than a heating target temperature and is lower than a heating target upper limit value.

14. The heating apparatus according to claim 13, wherein the current-feed controller executes the second current-feed mode at a timing when the detection temperature increases.

15. A heating apparatus comprising:

a heater;

a switching circuit configured to switch on/off current-feeding from an AC power source to the heater;

a temperature detector configured to detect a temperature of the heater;

a current-feed controller configured to execute a first current-feed mode of changing a current-feed ratio of current-feeding time to unit time by controlling switching of the switching circuit so that the temperature detected by the temperature detector falls within a target range, wherein the current-feed controller executes a second current-feed mode of fixing the current-feed ratio to almost 100% or almost 0% during execution of the first current-feed mode in place of the first current-feed mode; and a high-frequency wave calculator configured to calculate a high-frequency current value contained in a feeding current to the heater in a first period, wherein the current-feed controller determines a period of the second current-feed mode, which is required for a second period following the first period, on the basis of the calculated high-frequency current value.

16. The heating apparatus according to claim 15, wherein, in the second current-feed mode, a fixed period in which the current-feed ratio is fixed is equal to or larger than a predetermined time.

17. The heating apparatus according to claim 15, wherein, in the second current-feed mode, the current-feed controller extends a fixed period in which the current-feed ratio is fixed as power consumption of the heater is larger.

18. The heating apparatus according to claim 17, wherein the current-feed controller executes the second current-feed mode plural times at predetermined intervals during an execution period of the first current-feed mode.

19. The heating apparatus according to claim 17, wherein the fixed period is a period that is equal to or larger than a time in which illumination flicker due to heating control of the heater is restrained.

20. The heating apparatus according to claim 17, wherein in the second current-feed mode, the current-feed ratio is fixed to almost 100%, and wherein, before execution of the first current-feed mode after execution of the second current-feed mode, the current-feed controller executes a third mode of controlling the switching circuit at a current-feed ratio that is smaller than the current-feed ratio in the first current-feed mode.

21. The heating apparatus according to claim 20, wherein the current-feed controller executes the third mode for a period in which the detection temperature is lower than a heating target temperature.

22. The heating apparatus according to claim 17, wherein in the second current-feed mode, the current-feed ratio is fixed to almost 0%, and wherein, before execution of the first current-feed mode after execution of the second current-feed mode, the current-feed controller executes an other mode of controlling the switching circuit at a current-feed ratio that is larger than the current-feed ratio in the first current-feed mode.

23. The heating apparatus according to claim 15, wherein, in the second current-feed mode, the current-feed ratio is fixed to almost 100%, and wherein the current-feed controller executes the second current-feed mode at a timing when the detection temperature is higher than a heating target lower limit value and is lower than a heating target temperature.

24. The heating apparatus according to claim 23, wherein the current-feed controller executes the second current-feed mode at a timing when the detection temperature decreases.

25. The heating apparatus according to claim 15, wherein, in the second current-feed mode, the current-feed ratio is fixed to almost 0%, and wherein the current-feed controller executes the second current-feed mode at a timing when the detection temperature is higher than a heating target temperature and is lower than a heating target upper limit value.

26. The heating apparatus according to claim 25, wherein the current-feed controller executes the second current-feed mode at a timing when the detection temperature increases.

27. The heating apparatus according to claim 15, further comprising:

a temperature gradient detector configured to detect a temperature gradient of the detection temperature on the basis of the detection temperature, wherein the current-feed controller decreases a fixed period in which the current-feed ratio is fixed in the second current-feed mode as the detected temperature gradient is larger.

28. The heating apparatus according to claim 15, wherein, in the first current-feed mode, the current-feed controller executes a wave-number control to use a ratio of wave-number of the AC power source to the unit time as the current-feed ratio.

29. An image forming apparatus comprising:

an image forming unit configured to form a toner image on a recording medium; and the heating apparatus according to claim 15 as a fusing unit configured to fuse the toner image formed on the recording medium to the recording medium.

30. The image forming apparatus according to claim 29, wherein, in the second current-feed mode, the current-feed ratio is fixed to almost 100%, and wherein the current-feed controller prohibits execution of the second current-feed mode in an interval period in which the recording medium is conveyed to the fusing unit.

31. The image forming apparatus according to claim 29, wherein the current-feed controller executes the second current-feed mode of fixing the current-feed ratio to almost 0% in an interval period in which the recording medium is conveyed to the fusing unit.

32. The image forming apparatus according to claim 29, wherein the fusing unit includes a rotator that is disposed as opposed to the heater and rotates to convey the recording medium, and wherein the current-feed controller executes the second current-feed mode of fixing the current-feed ratio to almost 100% according to a timing when the recording medium is nipped between the heater and the rotator.

33. A heating apparatus comprising:

a heater;

a switching circuit configured to switch on/off current-feeding from an AC power source to the heater;

a temperature detector configured to detect a temperature of the heater; and a current-feed controller configured to execute a first current-feed mode of changing a current-feed ratio of current-feeding time to unit time by controlling switching of the switching circuit so that the temperature detected by the temperature detector falls within a target range, wherein the current-feed controller executes a second current-feed mode of fixing the current-feed ratio to almost 100% or almost 0% during execution of the first current-feed mode in place of the first current-feed mode, wherein, in the second current-feed mode, the current-feed controller extends a fixed period in which the current-feed ratio is fixed as power consumption of the heater is larger, wherein in the second current-feed mode, the current-feed ratio is fixed to almost 0%, and wherein, before execution of the first current-feed mode after execution of the second current-feed mode, the current-feed controller executes another mode of controlling the switching circuit at a current-feed ratio that is larger than the current-feed ratio in the first current-feed mode.

34. The heating apparatus according to claim 33, wherein in the second current-feed mode, the fixed period in which the current-feed ratio is fixed is equal to or larger than a predetermined time.

35. The heating apparatus according to claim 33, wherein the current-feed controller executes the second current-feed mode plural times at predetermined intervals during an execution period of the first current-feed mode.

36. The heating apparatus according to claim 33, wherein the fixed period is a period that is equal to or larger than a time in which illumination flicker due to heating control of the heater is restrained.

37. The heating apparatus according to claim 33, further comprising:

a temperature gradient detector configured to detect a temperature gradient of the detection temperature on the basis of the detection temperature, wherein the current-feed controller decreases the fixed period in which the current-feed ratio is fixed in the second current-feed mode as the detected temperature gradient is larger.

38. The heating apparatus according to claim 33, wherein, in the first current-feed mode, the current-feed controller executes a wave-number control to use a ratio of wave-number of the AC power source to the unit time as the current-feed ratio.

39. An image forming apparatus comprising:

an image forming unit configured to form a toner image on a recording medium; and the heating apparatus according to claim 33 as a fusing unit configured to fuse the toner image formed on the recording medium to the recording medium.

40. The image forming apparatus according to claim 39, wherein the current-feed controller executes the second current-feed mode of fixing the current-feed ratio to almost 0% in an interval period in which the recording medium is conveyed to the fusing unit.

* * * * *